United States Patent [19]

Manderscheid

[11] Patent Number: 5,046,557

[45] Date of Patent: Sep. 10, 1991

[54] WELL PACKING TOOL

[75] Inventor: Phillip H. Manderscheid, Cypress, Tex.

[73] Assignee: MASX Energy Services Group, Inc., Houston, Tex.

[21] Appl. No.: 516,645

[22] Filed: Apr. 30, 1990

[51] Int. Cl.[5] ..... E21B 33/129

[52] U.S. Cl. ..... 166/120; 166/134; 166/179

[58] Field of Search ..... 166/120, 134, 118, 179, 166/123, 181, 182

[56] References Cited

U.S. PATENT DOCUMENTS

| | | | |
|---|---|---|---|
| 3,233,675 | 2/1966 | Tamplen et al. | 166/120 |
| 3,374,837 | 3/1968 | Page et al. | 166/182 |
| 3,570,596 | 3/1971 | Young | 166/134 |
| 3,933,376 | 1/1976 | Cugini | 285/23 |
| 4,071,084 | 1/1978 | Brown et al. | 166/182 |
| 4,530,398 | 7/1985 | Greenlee et al. | 166/134 |
| 4,765,404 | 8/1988 | Bailey et al. | 166/134 |

FOREIGN PATENT DOCUMENTS

| | | | |
|---|---|---|---|
| 1227498 | 8/1960 | France | 166/134 |

*Primary Examiner*—Terry L. Melius

*Attorney, Agent, or Firm*—Edgar A. Zarins; Malcolm L. Sutherland

[57] ABSTRACT

A retrievable well packing tool suitable for high pressure environments which is hydraulically set within a well bore and thereafter mechanically released. The packer includes a pressure compensator which enhances the setting force, maintains a continual setting force during well operations, and equalizes differential pressures during release. Dual slips are provided to ensure rigid anchoring of the packer to the casing wall. The short, compact design of the packing tool facilitates running through the casing while reducing manufacturing costs. Inadvertent presetting of the packer is presented by positively locking all components.

32 Claims, 4 Drawing Sheets

WELL PACKING TOOL

BACKGROUND OF THE INVENTION

I. Field of the Invention

This invention relates to a retrievable packer for a well bore and, in particular, to a packer which is set within the well casing hydraulically, released mechanically for retrieval, and includes load transfer means to maintain secure setting and equalization means for proper release of the packing tool.

II. Description of the Prior Art

Well packers and similar well devices have been widely used in oil, gas and geothermal production to separate specific regions of a well bore. Prior packers include permanently set packing devices which are left within the will and temporary or retrievable packers which can be removed for further production. Generally the packers include one or more elastomeric elements to seal off the bore and at least one set of slips to set the device within the cased bore. The principal disadvantage of previous designs for retrievable well packers is that they are expensive to manufacture or to use due to the large number of components. Many require special devices for setting and/or retrieving the device.

Furthermore, with the increased depth of exploration and production, increased well temperature and pressures are encountered. The slip assembly and packing elements of many of the prior known packing devices are designed for nominal well pressures. As downhole pressures increase the ability of the slips and packing elements to hold the well casing decreases which could result in blowout of the packer and, at the very least, creeping of the packer from its original position. Either result can lead to a dangerous situation and lost production.

SUMMARY OF THE PRESENT INVENTION

The present invention overcomes the disadvantages of the prior known well packing tools by providing a hydraulically set, retrievable packer which includes a pressure compensation assembly for improved high pressure performance. Additionally, the short, compact configuration of the well packer makes it suitable for use in deviated or flanged up wells.

The well packing tool of the present invention includes a plurality of elastomeric packing elements adapted to be deformed into sealing contact with the casing wall. The packing elements are mounted to a mandrel having an axial passageway used to manipulate the packer. Mounted to the mandrel longitudinally above and below the packing elements are upper and lower slip assemblies. The slip assemblies include slip cones and circumferentially spaced slips which expand outwardly to engage the casing wall and set the packer. The setting elements of the tool are positively locked to prevent inadvertent presetting as the packer is run into the well bore. In a preferred embodiment of the invention, the packer is set using hydraulic pressure supplied through the mandrel and released mechanically by applying tension to the mandrel.

In order to provide secure operation of the well packing tool, the device is provided with a unique compensation assembly which serves several functions. The assembly provides added setting force to the slip assemblies and maintains the setting form despite variations in external and internal pressures. Load-transfer means are also incorporated for setting the tool and relaxing the packing elements for release. The compensation assembly also serves to equalize differential pressure just prior to packer retrieval. In a preferred embodiment, the compensation assembly is positioned between the upper slip assembly and the packing elements in order to apply the necessary force to the upper slips. The compensator includes a piston slidably disposed within a cylinder in fluid communication with the passageway of the mandrel and the external annulus surrounding the tool. A unidirectional seal associated with the cylinder seals against fluid flow in one direction while allowing fluid bleed in the opposite direction. The load transfer assembly is positioned between the packing elements and lower slip to ensure secure setting of the tool. The load transfer assembly incorporates a piston/cylinder arrangement which fluidly communicates with the mandrel and the exterior of the packer. Ratchet locks are included to maintain the setting force within the packer. Shear screws and a retractable dog assembly facilitate release of the packer for retrieval.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views in which.

DETAILED DESCRIPTION OF A PREFERRED EMBODIMENT OF THE PRESENT INVENTION

Figure 1:
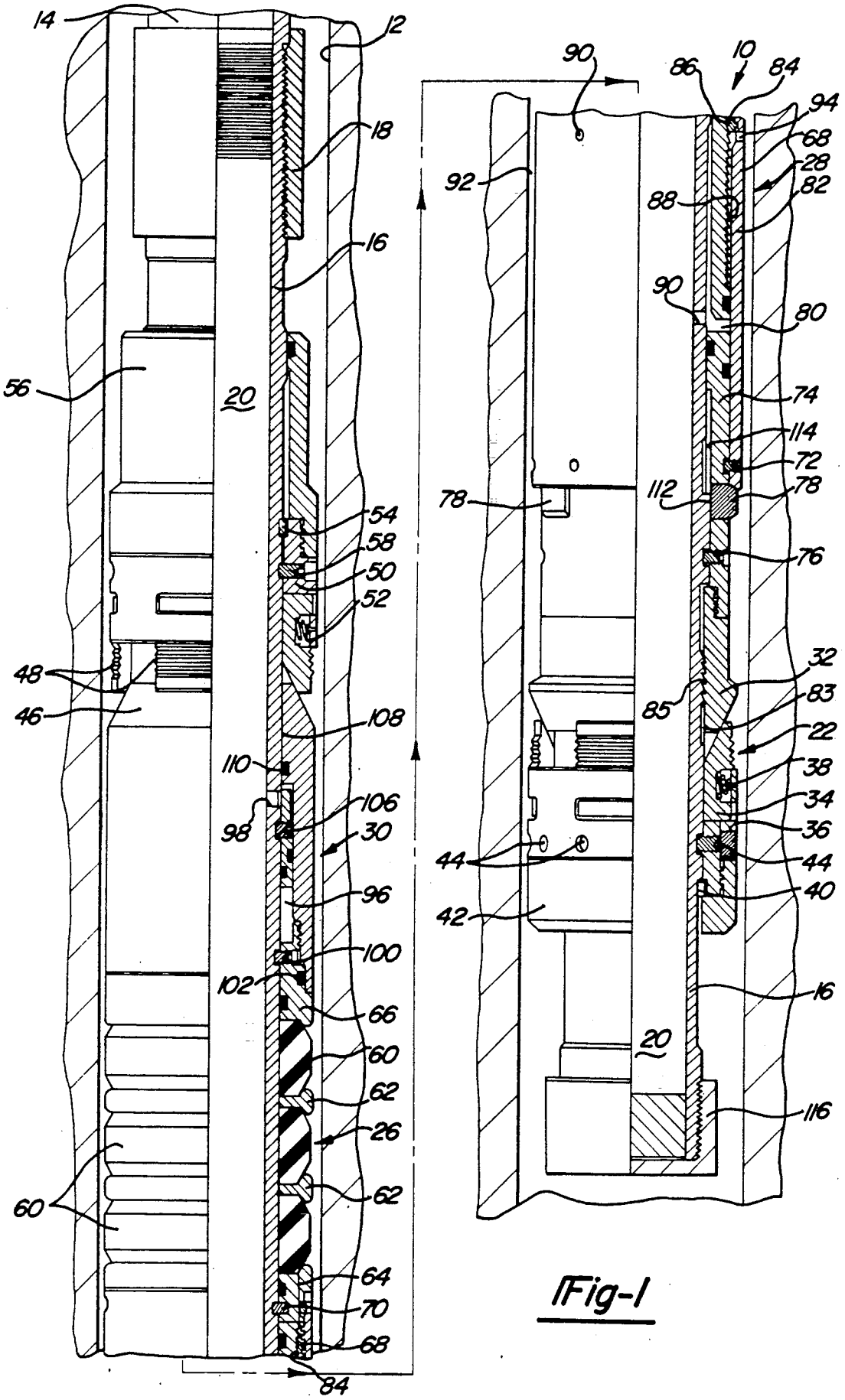
FIG. 1 is a partial cross-sectional view of the well packing tool embodying the present invention as it is run into a well bore.

Referring to the drawings there are shown two embodiments of a packing tool 10 adapted to be set in a casing 12 of a well bore. The well packing tool 10 of the present invention is run into the casing 12 and hydraulically set therein, as will be subsequently described, using a tubing string 14. The packing tool 10 of the present invention is designed for high pressure performance to separate sections of a well.

Figure 2:
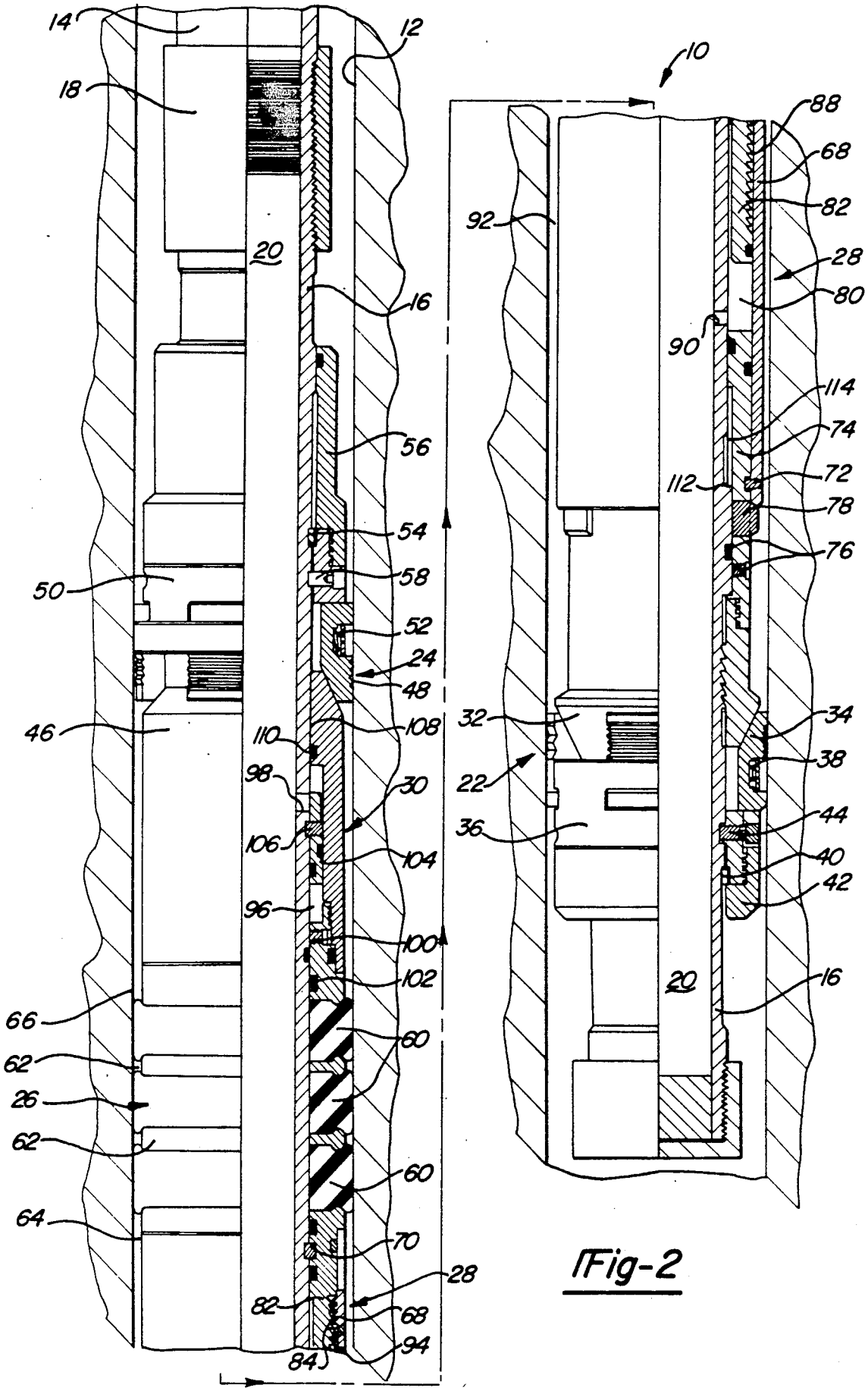
FIG. 2 is a partial cross-sectional view of the well packing tool set within the well casing.
Figure 3:
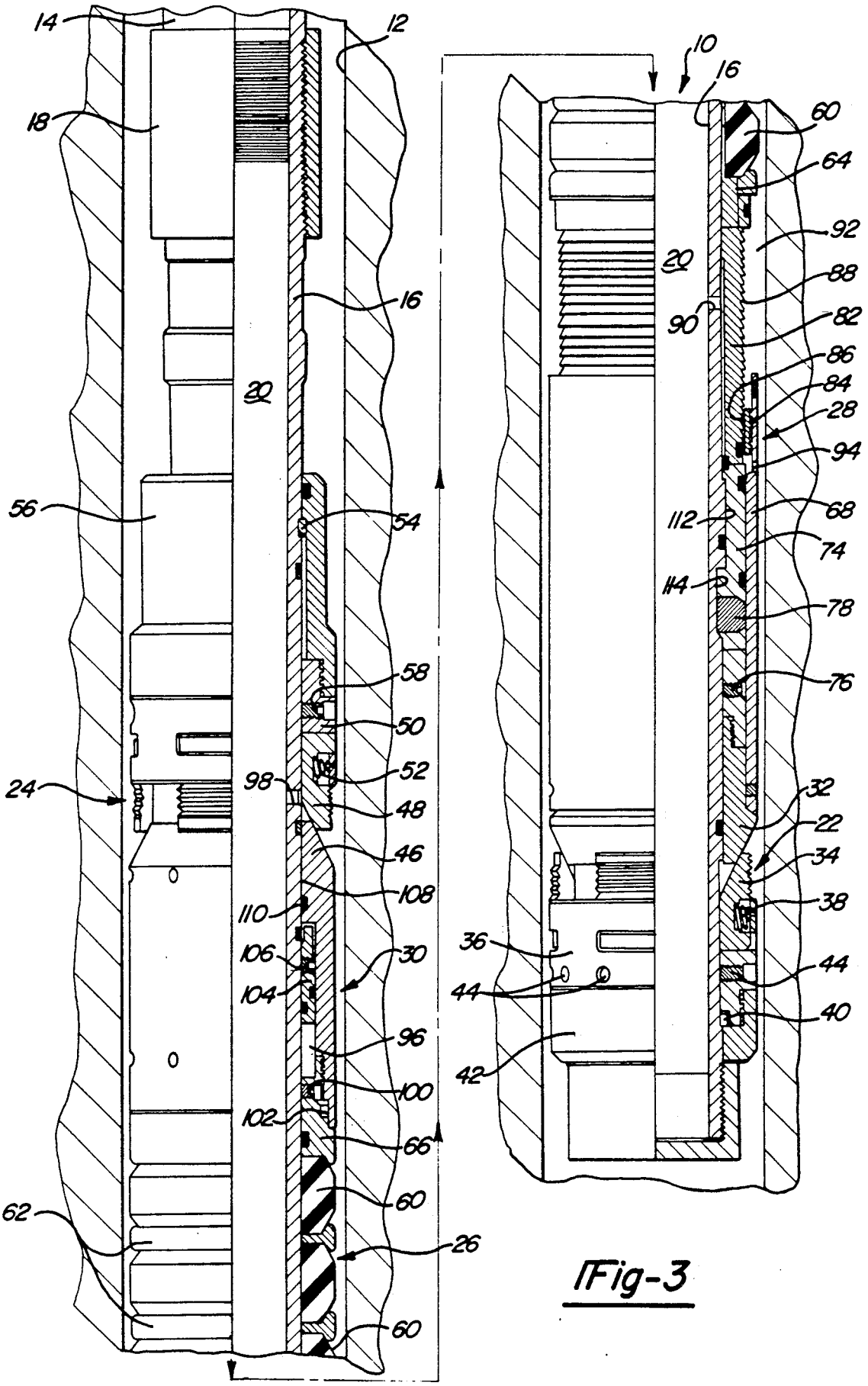
FIG. 3 is a partial cross-sectional view of the well packing tool released for retrieval from the well casing.

Referring first to FIGS. 1 through 3, the well packing tool 10 includes an inner mandrel 16 which is connected to the tubing string 14 by way of a threaded sub 18. The mandrel 16 has an axial fluid passageway 20 through which hydraulic fluid pressure is supplied for setting the packer 10 as will be subsequently described. Adjustably mounted to the exterior of the mandrel 16 are the setting components of the tool 10, namely, lower slip assembly 22, upper slip assembly 24 and packer 26 disposed between the upper and lower slip assemblies. The high pressure performance of the packing tool 10 of the present invention is enhanced by load transfer means associated with the setting components of the tool 10. In a preferred embodiment, the load transfer means comprises a lower transfer assembly 28 interconnected between the lower slip assembly 22 and the packer 26 and an upper transfer assembly 30 interconnected between the upper slip assembly 24 and the packer 26.

The lower slip assembly 22 includes a slip cone 32 engaging outwardly expandable slip elements 34 which are retained by lower slip housing 36. The slip elements 34 are inwardly biased by springs 38 to facilitate retraction of the slips 34 during release. The lower slip housing 36 is attached to end cap 42. Snap ring 40 prevents accidental setting of the tool in the event the packer encounters an obstruction as it is run into the hole by transferring such abutment to the mandrel 16. A series of circumferentially spaced lower release pins 44 prevent longitudinal movement of the lower slip housing 36 to facilitate setting of the lower slip assembly 22.

Similarly, the upper slip assembly 24 includes a slip cone 46 which engages outwardly expandable slip elements 48. The slip elements 48 are retained by upper slip housing 50 and biased inwardly by springs 52. The upper slip housing 50 abuts against snap ring 54 and is attached to top cap 56. The upper slip housing 50 is secured against longitudinal movement relative to the mandrel 16 by the snap ring 54 in conjunction with a series of circumferentially spaced upper release pins 58.

The packer 26 comprises a plurality of packing elements 60 having spacers 62 disposed therebetween. The packing elements 60 and spacers 62 are slidably mounted to the mandrel 16 and retained between a lower seal retainer 64 and an upper seal retainer 66. The seal retainers 64 and 66 and the spacers 62 ensure uniform setting and sealing of the packing elements 60 against the casing 12 to pack-off the well bore. The packing elements 60 are preferably made of a resilient elastomeric material such that the elements 60 will return to their original shape upon release of the tool 10.

Referring still to FIGS. 1-3, the load transfer means of the present invention ensures proper setting of the tool 10 under hydraulic pressure supplied through the mandrel 16 as well as maintenance of the setting pressure even under varying downhole differential pressures. The lower transfer assembly 28 interconnected between the lower slip assembly 22 and the packer 26 comprises a locking cylinder 68 connected at one end to the lower seal retainer 64 by a series of setting shear screws 70 and connected at its other end by a series of release pins 72 to a load body 74 which is slidably mounted to the inner mandrel 16. The load body 74 is initially secured to the mandrel 16 by a series of setting shear screws 76 to prevent setting of the tool 10 as it is run into the well bore. The load body 74 includes at least one retractable dog 78 which retards relative movement of the locking cylinder 68 with respect to the load body 74. The load body 74 is connected at its lower end to the lower slip cone 32.

The lower seal retainer 64, the locking cylinder 68, the load body 74 and the inner mandrel 16 combine to form a chamber 80 within which is adjustably disposed a locking sleeve 82. The locking sleeve 82 is adjustably connected to the locking cylinder 68 by a locking nut 84 which includes a ratcheted inner surface 86 in cooperation with an outer ratcheted surface 88 of the locking sleeve 82 such that the locking cylinder 68 can be longitudinally adjusted relative to the locking sleeve 82 in only one direction. The locking nut 84 is threadably secured to the locking cylinder 68 to prevent relaxation of the packing elements 60. In order to set the tool 10 and to compensate for differential pressures surrounding the tool 10, the chamber 80 fluidly communicates with the inner fluid passageway 20 of the mandrel 16 through inner port 90 and with the annulus 92 surrounding the tool 10 through outer port 94. In addition to the ratcheted locking nut 84, a secondary ratcheted locking member 83 is mounted to the mandrel 16 beneath the lower slip cone 32. The lower slip cone 32 includes an inner ratcheted surface 85 which cooperates with the ratcheted surface of the locking member 83 to prevent inadvertent relaxation of the lower slip 22 as well as the packing elements 60. In the event a differential pressure is encountered by the packing elements 60 which tends to draw the lower seal retainer 64 and locking sleeve 82 upwardly in relation to the locking cylinder 68 which is maintained by the locking nut 83 thereby increasing the setting tension applied to the tool 10.

The upper transfer assembly 30 interconnected between the upper slip assembly 24 and the packer 26 also compensates for variations in differential pressure while facilitating hydraulic setting of the tool 10. The upper transfer assembly 30 comprises a cylinder 96 formed by the upper slip cone 46, which connected directly to the upper seal retainer 66, and the inner mandrel 16. The cylinder 96 fluidly communicates with the inner fluid passageway 20 through inner fluid port 98. The upper seal retainer 66 which forms an end wall of the cylinder 96 is initially secured against movement relative to the mandrel 16 by a series of setting shear screws 100. Furthermore, in addition to the various 0-ring seals, the upper seal retainer 66 includes a fluid leak path 102 which provides fluid communication between the cylinder 96 and the annulus 92 surrounding the tool 10. Slidably disposed within the cylinder 96 is a piston 104 which is initially secured to the mandrel 16 by pins 106. In order to equalize fluid pressure prior to release of the tool 10, the upper slip cone 46 includes an equalization passageway 108 past the slip cone 46 to allow equalization flow in conjunction with the inner port 98 of the mandrel.

Figure 4:
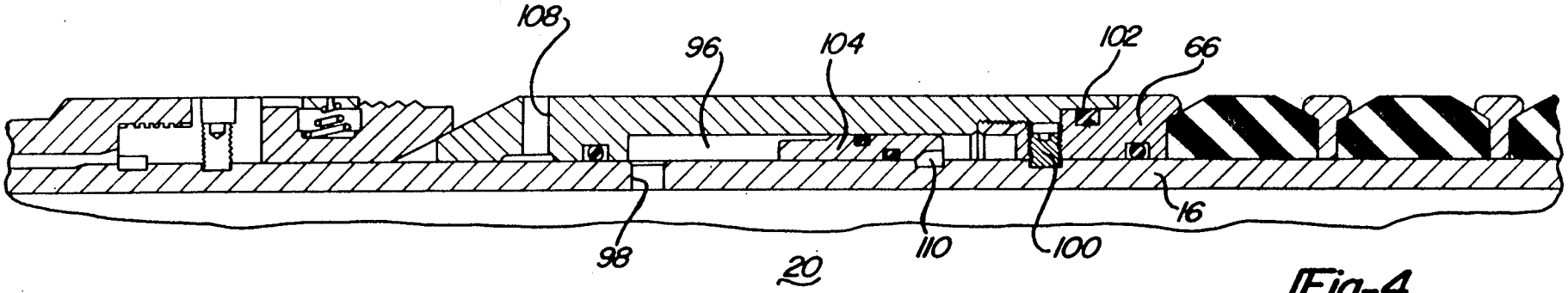
FIG. 4 is a partial cross-sectional view of a second embodiment of the well packing tool having an alternative compensation assembly.

A second embodiment of the upper compensation assembly is shown in FIG. 4. Instead of the release pin, the piston 104 is retained by a snap ring 110 which limits the longitudinal movement of piston 104. A poly-pack unidirectional seal 103 is used to bleed differential pressures through the upper transfer assembly. As with the first embodiment, the upper transfer assembly 30 serves as an additional cylinder during setting to yield a tighter set of the tool, holds down the mandrel when acted upon by internal pressure, and maintains a continual setting force into the upper slip cone and slips.

Operation of the present invention allows secure hydraulic setting of the packing tool 10 and mechanical release for retrieval from the well. Once the packing tool 10 is positioned using the tubing string 14, hydraulic pressure is supplied through the fluid passageway 20 and through inner ports 98 and 90 of the upper 20 and lower 28 transfer assemblies, respectively. The increased fluid pressure within the chambers 96 and 80 will simultaneously shear setting screws 70 and 76 of the lower transfer assembly 28 and setting screws 58 of the upper transfer assembly 30. The hydraulic pressure through port 98 will move upper slip cone 46 beneath slip elements 48 setting the upper slip assembly 24 and pressure through port 90 will move load body 74 and lower slip cone 32 downwardly beneath slip elements 34 setting the lower slip assembly 22. As the lower slip cone 32 moves relative to the mandrel 16 the ratchet surface 85 will travel along the ratchet surface of locking member 83. Simultaneously, the locking sleeve 82, which is now free to move away from the locking cylinder 68, and the lower seal retainer 64 will be forced upwardly thereby compressing the packing elements 60 against the upper seal retainer 66 fixed against further movement by the set upper slip assembly 24. Compression of the packing elements 60 will move the elements 60 into sealing engagement with the casing wall 12 as is shown in FIG. 2. The ratchet connection between the locking cylinder 68, the lock nut 84 and the locking sleeve 82 prevents retraction of the packer 26, the lower slip assembly 22 or the upper slip assembly 24 by maintaining the separation between the locking sleeve 82 from the load body 74. Additional hydraulic pressure increases the setting pressure of the components of the packing tool 10. Thus, the load created by the hydraulic pressure within the lower transfer assembly 28 is continuously transferred to increase the setting strength of the packer 26 and lower slip assembly 22.

With the packing tool set in the well casing 12, any differential pressures within the well will be compensated by the present invention. External differential pressure from downhole of the tool 10 acts upward on the packing elements 60, transmitting the force through the upper seal retainer 66 to the upper slip cone 46 forcing the upper slip elements 48 into the casing. Similarly, differential pressure from above acts downward on packing elements 60, transmitting the force through the lower seal retainer 64, the locking sleeve 82, lock nut 84, locking cylinder 68 and dogs 78 into the load body 74 and lower slip cone 32 forcing the lower slip elements 34 with greater force into the casing wall 12. Differential pressure within the mandrel 16 acts through ports 98 against the compensation piston 104 to prevent upward movement of the mandrel 16 which is locked to the piston 104 by pins 106. The force is transmitted through the upper slip cone 46 and upper slips 48 into the casing wall 12. The balanced hydraulic pressure within the cylinder 96 holds the piston 104 and mandrel 16 down.

The packing tool 10 of the present invention is released by applying a predetermined tension to the setting string 14 and the mandrel 16. The tension applied to the mandrel 16 initially shears release pins 44 of the lower slip assembly 22 and release pins 58 of the upper slip assembly 24 thereby releasing these components from the mandrel 16. Continued tension will move the port 98 past seal 110 of the upper slip cone 46 to equalize any differential pressure while also removing any scale, barite or other debris from the upper slip assembly 24. Continued tension will move the shoulder 112 on the mandrel 16 upwardly until it engages the load body 74 allowing the dogs 78 to fall into the cavity 114 in the mandrel 16. This tension will also release the lower slips 34 and shear release pins 72 allowing the lower slip assembly 22 to fall until it rests on the bottom coupling 116. Simultaneously the locking sleeve 82, locknut 84, cylinder 68 and lower seal retainer 64 are free to fall to engage lower cone 32 thereby relaxing the packing elements 60. Continued tension enables the snap ring 54 on the mandrel 16 to bump and pick-up the top cap 56 pulling the upper slip housing 50 to retract the upper slips 48. The released packing tool 10 can now be retrieved from the well casing 12.

Figure 5:
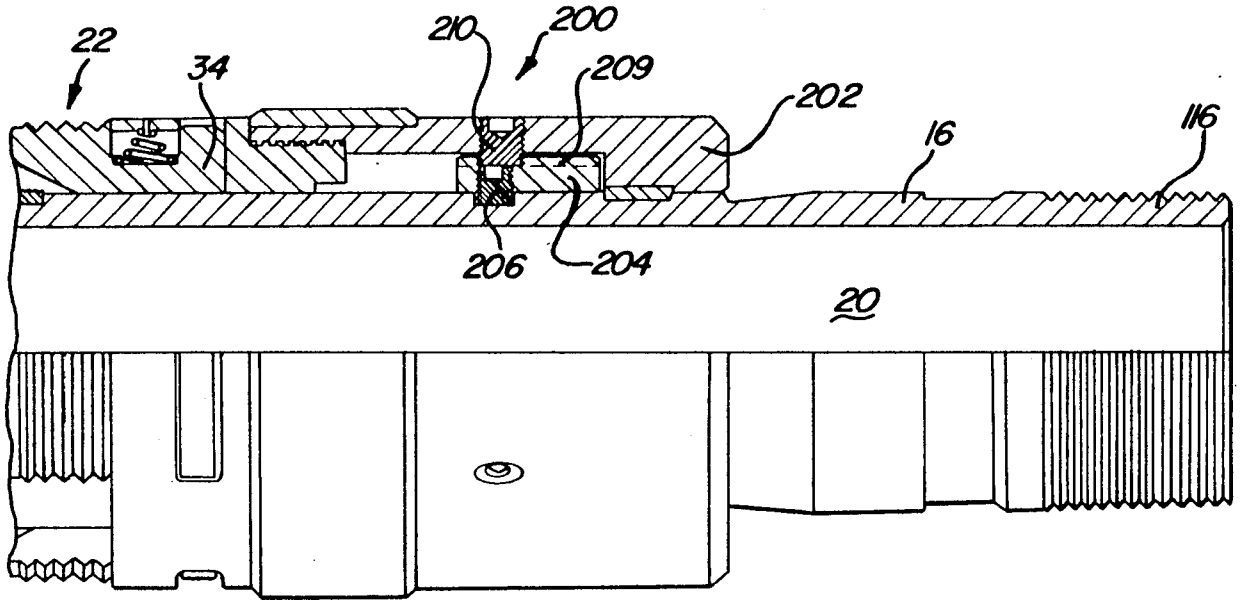
FIG. 5 is a partial cross-sectional view of a J-latch assembly of the downhole end of the well packing tool.

In a still further embodiment shown in FIG. 5, in the event a none shear release of the packing tool 10 is desired, a J-latch 200 can be incorporated into the lower end cap 202. The J-latch 200 includes a slotted member 204 connected to the mandrel 16 by shear pins 206. A J-slot 208 in the member 204 receives pin 210 extending through the end cap 202. In order to release the packing tool 10 right hand rotation is applied to the mandrel 16 through the string 14 thereby releasing the J-latch 200 allowing an upward pull to release the packing tool 10. Accordingly, tension required to shear screws 44 is not required.

The foregoing detailed description has been given for 1 clearness of understanding only and no unnecessary limitations should be understood therefrom as some modifications will be obvious to those skilled in the art without departing from the scope and spirit of the appended claims.

What is claimed is:

1. A well packing tool for setting in a casing, said packing tool comprising:

an inner mandrel detachably connected to a setting string, said mandrel including a fluid passageway;

a lower slip assembly mounted to said mandrel and selectively engageable with the casing, said lower slip assembly including a slip cone and a plurality of slip elements;

an upper slip assembly mounted to said mandrel and selectively engageable with the casing, said upper slip assembly including a slip cone and a plurality of slip elements;

at least one elastomeric packing element mounted to said mandrel between said upper and lower slip assemblies, said at least one packing element resiliently compressible into sealing engagement with the casing upon setting of said tool; and load transfer means mounted to said mandrel interconnected with said upper and lower slip assemblies, said means responsive to downhole fluid pressure acting on said tool to compensate for variations in fluid pressure thereby maintaining sealing engagement of aid at least one elastomeric packing element and the engagement of said upper and lower slip assemblies with the casing.

2. The packing tool as defined in claim 1 wherein said load transfer means includes an upper transfer assembly interconnected between said upper slip assembly and said at least one packing element and a lower transfer assembly interconnected between said lower slip assembly and said at least one packing element.

3. The packing tool as defined in claim 2 wherein said upper transfer assembly comprises a piston movably captured within a cylinder in selective fluid communication with said fluid passageway of said mandrel and the annulus surrounding said tool.

4. The packing tool as defined in claim 3 wherein said cylinder of said upper transfer assembly is formed by said mandrel and an outer ring slidably mounted to said mandrel, said outer ring of said upper transfer assembly formed by said slip cone of said upper slip assembly and an upper seal retainer compressibly engaging said at least one packing element.

5. The packing tool as defined in claim 4 wherein said lower transfer assembly includes a ratchet locking member mounted to said mandrel and cooperatingly engaging said lower slip assembly.

6. The packing tool as defined in claim 2 wherein said lower transfer assembly comprises a locking sleeve movably disposed within a housing chamber in fluid communication with said fluid passageway of said mandrel and the annulus surrounding said tool.

7. The packing tool as defined in claim 6 wherein said chamber is formed by said mandrel and an outer housing slidably mounted to said mandrel, said outer housing of said lower transfer assembly formed by a lower seal retainer compressibly engaging said at least one packing element, a load body connected to said slip cone of said lower slip assembly, and a locking cylinder detachably connected to said lower seal retainer and said load body to form said housing chamber.

8. The packing tool as defined in claim 7 wherein said locking sleeve is adjustably secured to said locking cylinder by a lock nut.

9. The packing tool as defined in claim 7 wherein said load body includes a plurality of retractable dogs, said retractable dogs selectively locking said locking cylinder against movement relative to said load body, said locking cylinder longitudinally displaceable upon retraction of said dogs to release said packing tool.

10. The packing tool as defined in claim 2 wherein said lower slip assembly, said upper slip assembly, said lower transfer assembly, and said upper transfer assembly are selectively detachably secured against longitudinal movement relative to said mandrel by a plurality of shear screws thereby preventing inadvertent setting of said packing tool.

11. The packing tool as defined in claim 2 and further comprising an equalization passageway to equalize fluid pressure between the outer annulus surrounding said tool and said mandrel fluid passageway.

12. A well packing tool for setting in a casing, said packing tool comprising:

an inner mandrel having a fluid passageway;

a lower slip assembly mounted to said mandrel, said lower slip assembly including a slip cone and a plurality of slip elements selectively expansible into engagement with the casing;

an upper slip assembly mounted to said mandrel, said upper slip assembly including a slip cone and a plurality of slip elements selectively expansible into engagement with the casing;

a plurality of packing elements mounted to said mandrel between said upper and lower slip assemblies, said packing elements resiliently compressible between lower and upper seal retainers into sealing engagement with the casing upon setting of the tool; and load transfer means mounted to said mandrel, said means responsive to downhole fluid pressures acting on said tool to maintain sealing engagement of said packing elements and the engagement of said upper and lower slip assemblies with the well casing;

said load transfer means including an upper transfer assembly interconnected between said slip cone of said upper slip assembly and said upper seal retainer, said upper transfer assembly including a cylinder fluidly communicating with said fluid passageway of said mandrel and the annulus surrounding said tool through an upper exterior fluid passageway, a piston slidably captured within said cylinder.

13. The packing tool as defined in claim 12 wherein said load transfer means further comprises a lower transfer assembly interconnected between said slip cone of said lower slip assembly and said lower seal retainer, said lower transfer assembly including a locking sleeve movably disposed within a housing chamber fluidly communicating with said fluid passageway of said mandrel.

14. The packing tool as defined in claim 13 wherein said chamber of said lower transfer assembly fluidly communicates with the annulus surrounding said tool through a lower exterior fluid port.

15. The packing tool as defined in claim 13 wherein said locking sleeve of said lower transfer assembly includes a ratchet surface to lockingly connect said locking sleeve to a wall of said housing, said housing wall including a ratcheted lock nut interdisposed between said locking sleeve and said housing wall.

16. The packing tool as defined in claim 15 wherein said housing of said lower transfer assembly includes a load body connected to said slip cone of said lower slip assembly and a locking cylinder detachably secured to said load body, said load body having a plurality of retractable dogs selectively locking said locking cylinder against movement relative to said load body, said locking cylinder longitudinally displaceable upon retraction of said dogs to release said packing tool.

17. The packing tool as defined in claim 12 wherein said upper transfer assembly includes an equalization passageway to equalize fluid pressure between the outer annulus surrounding said tool and said mandrel fluid passageway.

18. A well packing tool for setting in a casing, said packing tool comprising:

an inner mandrel connected to a tubing string, said mandrel including a fluid passageway;

a lower slip assembly mounted to said mandrel, said lower slip assembly including a slip cone and a plurality of slip elements selectively expansible into engagement with the casing;

an upper slip assembly mounted to said mandrel, said upper slip assembly including a slip cone and a plurality of slip elements selectively expansible into engagement with the casing;

a plurality of packing elements mounted to said mandrel between said upper and lower slip assemblies, said packing elements resiliently compressible between lower and upper seal retainers into sealing engagement with the well casing upon setting of said tool;

a lower load transfer assembly interconnected between said slip cone of said lower assembly and said lower seal retainer, said lower load transfer assembly fluidly communicating with said fluid passageway of said mandrel and the annulus surrounding the tool to compensate for differential downhole fluid pressures; and an upper load transfer assembly interconnected between said slip cone of said upper slip assembly and said upper seal retainer, said upper load transfer assembly fluidly communicating with said fluid passageway of said mandrel;

whereby hydraulic fluid pressure is delivered through said fluid passageway of said mandrel to said upper load transfer assembly and said lower load transfer assembly to set said packing elements and said upper and lower slip assemblies against said well casing, said load transfer assemblies responsive to variations in downhole fluid pressures acting on said tool to maintain engagement of said slip assemblies and packing elements.

19. The packing tool as defined in claim 18 wherein said lower load transfer assembly includes a locking sleeve movably disposed within a housing chamber fluidly communicating with said fluid passageway of said mandrel, said locking sleeve having a ratchet surface to lockingly connect said locking sleeve to a wall of said housing, thereby preventing relaxation of said packing elements and said slips.

20. The packing tool as defined in claim 18 wherein said upper load transfer assembly includes a cylinder fluidly communicating with said fluid passageway and a piston slidably disposed within said cylinder.

21. The packing tool as defined in claim 18 wherein said lower load transfer assembly includes a ratchet locking member mounted to said mandrel and cooperatingly engaging said lower slip assembly to prevent relaxation of said lower slip assembly and said packing elements.

22. The packing tool as defined in claim 18 and further comprising a J-latch assembly at a downhole end of said packing tool for release of said tool.

23. A well packing tool for setting in a casing, said packing tool comprising:

an inner mandrel detachably connected to a setting string, said mandrel including a fluid passageway;

a lower slip assembly mounted to said mandrel and selectively engageable with the casing, said lower slip assembly including a slip cone and a plurality of slip elements;

an upper slip assembly mounted to said mandrel and selectively engageable with the casing, said upper slip assembly including a slip cone and a plurality of slip elements;

at least one elastomeric packing element mounted to said mandrel between said upper and lower slip assemblies, said at least one packing element resiliently compressible into sealing engagement with the casing upon setting of said tool; and load transfer means mounted to said mandrel, said means responsive to downhole fluid pressures acting on said tool to enhance sealing engagement of said at least one elastomeric packing element and the engagement of said upper and lower slip assemblies with the casing;

said load transfer means including an upper transfer assembly interconnected between said upper slip assembly and said at least one packing element and a lower transfer assembly interconnected between said lower slip assembly and said at least one packing element, said lower transfer assembly including a locking sleeve movably disposed within a housing chamber formed by said mandrel and an outer housing slidably mounted to said mandrel, said housing chamber in fluid communication with said fluid passageway of said mandrel and the annulus surrounding said tool for load transfer in response to variations in downhole fluid pressures.

24. The packing tool as defined in claim 23 wherein said outer housing of said lower transfer assembly is formed by a lower seal retainer compressibly engaging said at least one packing element, a load body connected to said slip cone of said lower slip assembly, and a locking cylinder detachably connected to said lower seal retainer and said load body to form said housing chamber.

25. The packing tool as defined in claim 24 wherein said locking sleeve is adjustably secured to said locking cylinder by a lock nut.

26. The packing tool as defined in claim 24 wherein said load body includes a plurality of retractable dogs, said retractable doges selectively locking said locking cylinder against movement relative to said load body, said locking cylinder longitudinally displaceable upon retraction of said dogs to release said packing tool.

27. The packing tool as defined in claim 23 wherein said upper transfer assembly comprises a piston movably captured within a cylinder formed by said mandrel and an outer housing slidably mounted to said mandrel, said cylinder in fluid communication with said fluid passageway of said mandrel and the annulus surrounding said tool for load transfer in response to variations in downhole fluid pressures.

28. The packing tool as defined in claim 27 wherein said outer housing of said upper transfer assembly is formed by said slip cone of said upper slip assembly and an upper seal retainer compressibly engaging said at least one packing element, said piston and said outer housing independently slidable along said mandrel in response to variations in downhole fluid pressure thereby enhancing engagement of said upper slip assembly and said at least one packing element.

29. In a packing tool for setting in a casing, the packing tool including an inner mandrel having a fluid passageway, upper and lower slip assemblies mounted to the mandrel and selectively engageable with the casing and a packer assembly having at least one packing element mounted to the mandrel between the slip assemblies, the packer assembly compressible into sealing engagement with the casing upon setting of the tool, the improvement comprising:

load transfer means mounted to the mandrel and responsive to downhole fluid pressures acting on the packing tool to adjust the engagement of the slip assemblies and packer assembly, said load transfer means including an upper transfer assembly having a piston slidably disposed within a cylinder fluidly communicating with the fluid passageway of the mandrel to set the upper slip assembly and the packer assembly and a lower transfer assembly having a piston slidably disposed within a chamber fluidly communicating with the fluid passageway of the mandrel to set the lower slip assembly and the packer assembly.

30. The packing tool as defined in claim 29 wherein said cylinder of said upper transfer assembly selectively fluidly communicates with the annulus surrounding the tool through an upper exterior fluid passageway.

31. The packing tool as defined in claim 29 wherein said chamber of said lower transfer assembly fluidly communicates with the annulus surrounding the tool through a lower exterior fluid port.

32. The packing tool as defined in claim 31 wherein said lower transfer assembly includes a locking sleeve movably disposed within said chamber and lockingly connected to a locking cylinder forming a wall of said chamber, said locking cylinder detachably secured to a load body connected to said lower slip assembly.

* * * * *